United States Patent [19]

Sagoi et al.

[11] 4,253,873

[45] Mar. 3, 1981

[54] TITANIUM-BASED ALLOY HAVING HIGH MECHANICAL STRENGTH

[75] Inventors: Masayuki Sagoi, Yokohama; Masayuki Itoh, Kawasaki; Masami Miyauchi; Osamu Watanabe, both of Yokohama, all of Japan

[73] Assignee: Tokyo Shibaura Denki Kabushiki Kaisha, Kawasaki, Japan

[21] Appl. No.: 60,732

[22] Filed: Jul. 25, 1979

[30] Foreign Application Priority Data

Jul. 28, 1978 [JP] Japan ..... 53-92365
Feb. 28, 1979 [JP] Japan ..... 54-21914

[51] Int. Cl.[3] ..... C22C 14/00; C22F 1/18

[52] U.S. Cl. ..... 75/175.5; 148/32.5; 148/133

[58] Field of Search ..... 148/11.5 F, 12.7 B, 148/133, 32.5; 75/175.5

[56] References Cited

U.S. PATENT DOCUMENTS

| | | | |
|---|---|---|---|
| 2,892,706 | 6/1959 | Jaffee et al. | 75/175.5 |
| 3,666,453 | 5/1972 | Goosey | 148/32.5 |
| 3,833,363 | 9/1974 | Bomberger, Jr. et al. | 148/32.5 |

FOREIGN PATENT DOCUMENTS

| | | | |
|---|---|---|---|
| 873774 | 7/1961 | United Kingdom | 75/175.5 |

*Primary Examiner*—L. Dewayne Rutledge
*Assistant Examiner*—Peter K. Skiff
*Attorney, Agent, or Firm*—Oblon, Fisher, Spivak, McClelland & Maier

[57] ABSTRACT

A titanium-based alloy of a high mechanical strength, which provides an excellent material of, particularly turbine blades, comprising 2.0 to 5.0% by weight of aluminum, 1.0 to 9.0% by weight of molybdenum, 6.1 to 9.0% by weight of chromium, traces of impurities, and titanium constituting the balance. The alloy may further contain 0.05 to 0.2% by weight of silicon and/or 0.001 to 0.05% by weight of boron, as required.

10 Claims, No Drawings

TITANIUM-BASED ALLOY HAVING HIGH MECHANICAL STRENGTH

This invention relates to a titanium-based alloy having a high mechanical strength, which is suitable for use as a material of steam turbine blades, jet engine fans, gas turbine compressor blades, etc. requiring an excellent impact strength and a high tensile strength.

It was customary in the past to use 12 Cr steel as a material of steam turbines. Hoever, turbines tend to become larger recently, resulting in that the mechanical strength of 12 Cr steel barely meets the lower limit of the current requirement of a low pressure turbine blades particularly, of the final stage blade. The increase in size of turbines also raises a problem of mechanical strength of a rotor supporting the turbine blades. Conventional titanium-based alloys such as Ti-6% Al-4% V alloy and Ti-13% V-11% Cr-3% Al alloy are superior to 12 Cr steel in specific strength, but are markedly inferior to 12 Cr steel in impact strength, resulting in unsatisfactory reliability when used as the material of, for example, turbine blades. Further U.S. Pat. No. 2,596,485 discloses a Ti-Al-Mo-Cr alloy exhibiting an excellent bending workability. However, the alloy of this U.S. Patent is low in mechanical strength, failing to provide a satisfactory material of turbine blades, or the like.

An object of this invention is to provide a titanium-based alloy exhibiting a high impact strength, a good forgeability and a high tensile strength, and being suitable for use as blades such as turbine blades, particularly, of large size.

According to this invention, there is provided a titanium-based alloy of a high mechanical strength, comprising 2.0 to 5.0% by weight of aluminum, 1.0 to 9.0% by weight of molybdenum, 6.1 to 9.0% by weight of chromium, and the balance of titanium. The alloy may further contain 0.05 to 0.2% by weight of silicon and/or 0.001 to 0.05% by weight of boron.

DETAILED DESCRIPTION OF THE INVENTION

Aluminum contained in the alloy of the present invention serves to improve the impact strength and tensile strength of the alloy. If the aluminum content is less than 2.0% by weight, the alloy fails to exhibit a sufficient tensile strength. On the other hand, the aluminum content higher than 5.0% by weight gives rise to an unsatisfactory impact strength of the alloy. Accordingly, the aluminum content of the alloy should range from 2.0 to 5.0% by weight, preferably, from 2.5 to 4.5% by weight.

Each of molybdenum and chromium used in this invention also serves to improve the impact strength and tensile strength of the alloy. The alloy is enabled to exhibit a satisfactory impact strength where the molybdenum content ranges between 1.0 and 9.0% by weight, preferably, between 1.5 and 5.0% by weight and the chromium content falls within the range between 6.1 and 9.0% by weight, preferably, between 6.1 and 8.0% by weight. If the amounts of molybdenum and chromium are lower than the lower limits mentioned above, the alloy fails to exhibit a sufficient tensile strength. On the other hand, if the amounts of these elements are higher than the upper limits mentioned above, the alloy fails to exhibit a satisfactory impact strength. It is also important to consider the total amount of molybdenum and chromium. If the total amount exceeds 18% by weight, the alloy is caused to decrease in impact strength. Further, molybdenum has a specific gravity of about 10.2 in contrast to about 7.2 for chromium, though these elements exhibit substantially the same effects. Thus, where a specific strength constitutes an important property as in the material of turbine blades, it is preferred to increase the chromium content relative to the molybdenum content.

Silicon contained in the alloy of the present invention serves to suppress the precipitation of $\alpha$-phase on grain boundaries, thereby enabling the alloy to exhibit improvements in ductility, impact strength and tensile strength. The silicon content should range between 0.05 and 0.2% by weight in this invention. If the silicon content is lower than 0.05% by weight, the effect mentioned above can not be realized. On the other hand, the silicon content exceeding 0.2% by weight leads to a decreased impact strength of the alloy.

In this invention, the presence of boron serves to strengthen the grain boundaries, resulting in the improvement of ductility of the alloy. If the boron content is lower than 0.001% by weight, the effect mentioned above can not be attained. On the other hand, the boron content exceeding 0.05% by weight leads to a decreased impact strength of the alloy.

In this invention, it is necessary to control properly the amounts of impurities in the alloy such as iron, oxygen, nitrogen and hydrogen for enabling the alloy to exhibit the desired properties without fail. Particularly, a large amount of oxygen, if present, may affect the properties of the alloy, rendering it necessary to prevent the oxygen from entering the alloy in a large amount. Specifically, it is preferred to control the oxygen content of the alloy at a level lower than about 2000 ppm.

Incidentally, the metal composition should be melted under vacuum or inert gas atmosphere in producing the alloy because the alloy of this invention contains titanium as the main component.

In the experiments described in the following, the alloy of this invention was subjected to a rapid forging treatment at 1,000° C., then, at 760° C., followed by a so-called "annealing heat treatment" at 760° C. or 800° C. The microstructure of the alloy after these treatment exhibited both $\beta$-phase having a BCC type crystal structure and a $\alpha$-phase having a HCP type crystal structure. However, the alloy of this invention may be treated in other ways. For example, it is possible to apply a so-called "$\beta$-processing" in which the forging treatment is carried out at a temperature causing $\beta$-transformation. Further, the annealing heat treatment mentioned above may be replaced by an annealing treatment within $\beta$-phase region or an aging heat treatment at a relatively low temperature within $(\alpha+\beta)$-phase region. Of course, it is possible to employ these treatments in combination.

EXAMPLES 1 TO 32

The alloys shown in Table 1 were melted by application of arc in a high purity argon atmosphere, followed by a rapid forging treatment at 1,000° C., then, at 760° C. so as to prepare alloy plates. The alloy plates of Examples 1 to 4, 9, 11 to 14, 19, 21 to 24, 29, 31 and 32 were maintained at 760° C. for 6 hours, followed by cooling within the furnace down to 600° C. and the subsequent air cooling so as to prepare samples. On the other hand, the alloy plates of Examples 5 to 8, 10, 15 to 18, 20 and 25 to 28 were maintained at 800° C. for 3 hours, followed by cooling within the furnace down to 540° C. and the subsequent air cooling so as to prepare samples.

The samples thus prepared were subjected to tensile tests and impact tests, the results being shown in Table 1. The samples used in the tensile test were sized at 12×2×3 mm on gauge position. On the other hand, the impact strength shown in Table 1 was obtained by applying charpy impact test to each of the samples having a V-notch of 2 mm.

Controls 1 to 6

The alloys shown in Table 1 were melted and forged as in the Examples described above so as to prepare alloy plates. The alloy plates of Controls 1 and 3 to 6 were maintained at 760° C. for 6 hours, followed by cooling within the furnace down to 600° C. and the subsequent air cooling so as to prepare samples. On the other hand, the alloy plate of Control 2 was maintained at 800° C. for 3 hours, followed by cooling within the furnace down to 540° C. and the subsequent air cooling.

The samples thus prepared were subjected to tensile tests and impact tests as in the Examples described above, the results being shown in Table 1.

Prior Arts A and B

Samples were prepared by applying an annealing treatment to each of prior art alloys of Ti-6% Al-4% V (sample A) and Ti-13% V-11% Cr-3% Al (sample B). These samples were subjected to tensile tests and impact tests as in the Examples described above, the results being shown in Table 1.

TABLE 1

| | Composition (weight %) | | | | | | | Properties | | |
|---|---|---|---|---|---|---|---|---|---|---|
| | Al | Mo | Cr | Si | B | Ti | Heat treatment | Tensile strength (kg/mm²) | Ductility % | Impact strength (Kg-m/cm²) |
| Ex. 1 | 2.1 | 1.1 | 6.3 | | | Balance | 760° C. × 6 hours → 600° C. (furnace cooling) (air cooling) | 86 | 18.2 | 8.2 |
| Ex. 2 | 2.2 | 1.1 | 8.7 | | | " | 760° C. × 6 hours → 600° C. (furnace cooling) (air cooling) | 92 | 17.8 | 6.3 |
| Ex. 3 | 2.1 | 8.8 | 6.2 | | | " | 760° C. × 6 hours → 600° C. (furnace cooling) (air cooling) | 89 | 15.8 | 7.5 |
| Ex. 4 | 2.3 | 8.6 | 8.9 | | | " | 760° C. × 6 hours → 600° C. (furnace cooling) (air cooling) | 90 | 14.5 | 6.4 |
| Ex. 5 | 4.8 | 1.3 | 6.1 | | | " | 800° C. × 3 hours → 540° C. (furnace cooling) (air cooling) | 95 | 14.2 | 6.5 |
| Ex. 6 | 4.7 | 1.2 | 8.6 | | | " | 800° C. × 3 hours → 540° C. (furnace cooling) (air cooling) | 98 | 15.0 | 6.0 |
| Ex. 7 | 4.7 | 8.9 | 6.5 | | | " | 800° C. × 3 hours → 540° C. (furnace cooling) (air cooling) | 97 | 13.3 | 7.5 |
| Ex. 8 | 5.0 | 8.6 | 8.9 | | | " | 800° C. × 3 hours → 540° C. (furnace cooling) (air cooling) | 101 | 11.9 | 6.0 |
| Ex. 9 | 2.3 | 4.2 | 7.4 | | | " | 760° C. × 6 hours → 600° C. (furnace cooling) (air cooling) | 88 | 15.0 | 7.3 |
| Ex. 10 | 4.2 | 3.8 | 6.6 | | | " | 800° C. × 3 hours → 540° C. (furnace cooling) (air cooling) | 98 | 12.9 | 6.6 |
| Ex. 11 | 3.5 | 1.0 | 6.5 | | | " | 760° C. × 6 hours → 600° C. (furnace cooling) (air cooling) | 91 | 16.5 | 7.4 |
| Ex. 12 | 2.2 | 1.2 | 6.1 | 0.11 | | " | 760° C. × 6 hours → 600° C. (furnace cooling) (air cooling) | 93 | 20.1 | 8.5 |
| Ex. 13 | 2.2 | 1.1 | 8.7 | 0.18 | | " | 760° C. × 6 hours → 600° C. (furnace cooling) (air cooling) | 95 | 19.8 | 6.9 |
| Ex. 14 | 2.2 | 8.8 | 8.7 | 0.15 | | " | 760° C. × 6 hours → 600° C. (furnace cooling) (air cooling) | 97 | 15.7 | 7.0 |
| Ex. 15 | 4.7 | 1.2 | 6.3 | 0.11 | | " | 800° C. × 3 hours → 540° C. (furnace cooling) (air cooling) | 98 | 16.1 | 6.8 |
| Ex. 16 | 4.7 | 1.2 | 8.6 | 0.09 | | " | 800° C. × 3 hours → 540° C. (furnace cooling) (air cooling) | 100 | 15.8 | 6.4 |
| Ex. 17 | 4.8 | 8.9 | 6.2 | 0.10 | | " | 800° C. × 3 hours → 540° C. (furnace cooling) (air cooling) | 105 | 14.2 | 7.7 |
| Ex. 18 | 4.9 | 8.8 | 8.7 | 0.08 | | " | 800° C. × 3 hours → 540° C. (furnace cooling) (air cooling) | 110 | 12.8 | 6.4 |
| Ex. 19 | 2.3 | 4.2 | 7.4 | 0.07 | | " | 760° C. × 6 hours → 600° C. (furnace cooling) (air cooling) | 89 | 16.5 | 7.7 |
| Ex. 20 | 4.3 | 4.1 | 6.5 | 0.10 | | " | 800° C. × 3 hours → 540° C. (furnace cooling) (air cooling) | 107 | 14.3 | 6.8 |
| Ex. 21 | 2.1 | 8.8 | 8.7 | 0.05 | | " | 760° C. × 6 hours → 600° C. (furnace cooling) (air cooling) | 96 | 13.1 | 6.4 |
| Ex. 22 | 2.2 | 1.1 | 6.2 | | 0.01 | " | 760° C. × 6 hours → 600° C. (furnace cooling) (air cooling) | 85 | 22.3 | 8.3 |
| Ex. 23 | 2.2 | 1.1 | 8.8 | | 0.02 | " | 760° C. × 6 hours → 600° C. (furnace cooling) (air cooling) | 93 | 21.8 | 6.8 |
| Ex. 24 | 2.1 | 8.9 | 8.8 | | 0.01 | " | 760° C. × 6 hours → 600° C. (furnace cooling) (air cooling) | 91 | 19.8 | 6.5 |
| Ex. 25 | 4.8 | 1.2 | 6.5 | | 0.01 | " | 800° C. × 3 hours → 540° C. (furnace cooling) (air cooling) | 96 | 20.0 | 6.7 |
| Ex. 26 | 4.7 | 1.1 | 8.7 | | 0.04 | " | 800° C. × 3 hours → 540° C. (furnace cooling) (air cooling) | 97 | 18.7 | 6.3 |
| Ex. 27 | 4.9 | 8.7 | 6.3 | | 0.01 | " | 800° C. × 3 hours → 540° C. (furnace cooling) (air cooling) | 100 | 17.5 | 7.4 |
| Ex. 28 | 4.8 | 8.7 | 8.8 | | 0.01 | " | 800° C. × 3 hours → 540° C. (furnace cooling) (air cooling) | 103 | 16.4 | 6.1 |
| Ex. 29 | 2.3 | 4.3 | 7.6 | | 0.02 | " | 760° C. × 6 hours → 600° C. | 86 | 19.6 | 7.5 |

TABLE 1-continued

| | | Composition (weight %) | | | | | | | Properties | | |
|---|---|---|---|---|---|---|---|---|---|---|---|
| | | Al | Mo | Cr | Si | B | Ti | Heat treatment | Tensile strength (kg/mm²) | Ductility % | Impact strength (Kg-m/cm²) |
| Ex. | 30 | 4.5 | 4.1 | 6.3 | | 0.01 | " | (furnace cooling) (air cooling) 800° C. × 3 hours → 540° C. | 103 | 17.2 | 6.5 |
| Ex. | 31 | 2.2 | 4.5 | 8.1 | | 0.001 | " | (furnace cooling) (air cooling) 760° C. × 6 hours → 600° C. | 88 | 16.4 | 6.3 |
| Ex. | 32 | 4.5 | 1.3 | 6.5 | 0.07 | 0.001 | " | (furnace cooling) (air cooling) 760° C. × 6 hours → 600° C. | 96 | 18.9 | 7.1 |
| Control | 1 | 2.6 | 9.8 | 3.2 | | | " | (furnace cooling) (air cooling) 760° C. × 6 hours → 600° C. | 87 | 9.6 | 5.1 |
| Control | 2 | 4.1 | 6.3 | 4.7 | | | " | (furnace cooling) (air cooling) 800° C. × 3 hours → 540° C. | 92 | 12.3 | 5.2 |
| Control | 3 | 2.1 | 8.8 | 8.9 | 0.03 | | " | (furnace cooling) (air cooling) 760° C. × 6 hours → 600° C. | 98 | 10.1 | 6.2 |
| Control | 4 | 2.3 | 8.9 | 8.7 | 0.25 | | " | (furnace cooling) (air cooling) 760° C. × 6 hours → 600° C. | 91 | 10.9 | 2.3 |
| Control | 5 | 2.2 | 8.7 | 8.8 | | 0.0008 | " | (furnace cooling) (air cooling) 760° C. × 6 hours → 600° C. | 97 | 10.0 | 6.3 |
| Control | 6 | 2.1 | 8.8 | 8.9 | | 0.08 | " | (furnace cooling) (air cooling) 760° C. × 6 hours → 600° C. | 90 | 9.8 | 2.5 |
| Prior art | A | Ti-6% Al-4% V | | | | | | (furnace cooling) (air cooling) Annealing treatment | 93 | 7.8 | 3.5 |
| Prior art | B | Ti-13% V-11% Cr-3% Al | | | | | | Annealing treatment | 95 | 6.5 | 1.7 |

Table 1 clearly shows that the titanium-based alloy of this invention is excellent in impact strength, tensile strength and ductility and, thus, is suitable for use as a material of, particularly, large turbine blades. It should be noted that the titanium-based alloy generally is not satisfactory in machinability, rendering it necessary to apply forging to the alloy for producing turbine blades. In this respect, it is important to note that the alloy of this invention was quite free from cracking, even if it is subjected to rapid forging.

As described in detail, the titanium-based alloy of this invention is markedly advantageous over the conventional titanium-based alloy in impact strength, leading to a prominent improvement in reliability of turbine equipments. Further, the alloy of this invention is excellent in tensile strength and ductility and is far superior to 12 Cr steel in specific strength, making it possible to decrease the weight of the blade by the use of the invented alloy. It follows that the stress acting on the blade and the load applied to the rotor can be markedly reduced, rendering it possible to enlarge blade and to improve the capacity of turbine itself.

What we claim is:

1. A titanium-based alloy of a high mechanical strength, comprising 2.0 to 5.0% by weight of aluminum, 1.5 to 5.0% by weight of molybdenum, 6.1 to 9.0% by weight of chromium, and the balance of titanium, the alloy having a tensile strength of more than 88 kg/mm² and an impact strength of more than 6.6 kg. m/cm².

2. The alloy according to claim 1, comprising 2.5 to 4.5% by weight of aluminum, 1.5 to 5.0% by weight of molybdenum, 6.1 to 8.0% by weight of chromium, and the balance of titanium.

3. The alloy according to claim 1 or 2, which further comprises 0.05 to 0.2% by weight of silicon.

4. The alloy according to claim 1 or 2, which further comprises 0.001 to 0.05% by weight of boron.

5. The alloy according to claim 1 or 2, which further comprises 0.05 to 0.2% by weight of silicon and 0.001 to 0.05% by weight of boron.

6. A blade material, comprising 2.0 to 5.0% by weight of aluminum, 1.5 to 5.0% by weight of molybdenum, 6.1 to 9.0% by weight of chromium, and the balance of titanium, the blade material having a tensile strength of more than 88 kg/mm² and an impact strength of more than 6.6 kg.m/cm².

7. The blade material according to claim 6, comprising 2.5 to 4.5% by weight of aluminum, 1.5 to 5.0% by weight of molybdenum, 6.1 to 8.0% by weight of chromium, and the balance of titanium.

8. The blade material according to claim 6 or 7, which further comprises 0.05 to 0.2% by weight of silicon.

9. The blade material according to claim 6 or 7, which further comprises 0.001 to 0.05% by weight of boron.

10. The blade material according to claim 6 or 7, which further comprises 0.05 to 0.2% by weight of silicon and 0.001 to 0.05% by weight of boron.

* * * * *